US010232609B2

(12) United States Patent
Hiyoshi

(10) Patent No.: US 10,232,609 B2
(45) Date of Patent: Mar. 19, 2019

(54) INK JET HEAD AND INK JET PRINTER

(71) Applicant: TOSHIBA TEC KABUSHIKI KAISHA, Tokyo (JP)

(72) Inventor: Teruyuki Hiyoshi, Izunokuni Shizuoka (JP)

(73) Assignee: Toshiba TEC Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/674,830

(22) Filed: Aug. 11, 2017

(65) Prior Publication Data

US 2018/0079204 A1 Mar. 22, 2018

(30) Foreign Application Priority Data

Sep. 16, 2016 (JP) ..... 2016-181681

(51) Int. Cl.
*B41J 2/045* (2006.01)

(52) U.S. Cl.
CPC ..... *B41J 2/04541* (2013.01); *B41J 2/04581* (2013.01); *B41J 2/04586* (2013.01)

(58) Field of Classification Search
CPC ..... B41J 2/04541; B41J 2/04586
See application file for complete search history.

(56) References Cited

U.S. PATENT DOCUMENTS 5,363,134 A 11/1994 Barbehenn et al.
6,079,805 A 6/2000 Kishi
8,052,239 B2 11/2011 Arakawa et al.
8,191,981 B2 6/2012 Arakawa
2005/0110814 A1 5/2005 Imai
2009/0167798 A1 7/2009 Ide et al.
2011/0148961 A1 6/2011 Arakawa et al.

FOREIGN PATENT DOCUMENTS

EP 1902842 A2 3/2008
EP 2065197 A1 6/2009
JP 2007-237422 9/2007

OTHER PUBLICATIONS

Extended European Search Report dated Feb. 27, 2018 filed in counterpart European Patent Application No. 17189862.0 (7 pages).

*Primary Examiner* — Julian D Huffman
*Assistant Examiner* — Michael T Konczal
(74) *Attorney, Agent, or Firm* — Kim & Stewart LLP

(57) ABSTRACT

An ink jet head includes a nozzle connected to an ink chamber, an actuator configured to change a pressure of the ink chamber, a driver circuit configured to supply a drive waveform to the actuator in response to a control signal, a non-volatile memory configured to store information for setting the drive waveform, a first signal line via which a logic power supply voltage is supplied to the driver circuit, a second signal line via which the control signal is supplied to the driver circuit, a third signal line via which the logic power supply voltage is supplied to the non-volatile memory, a fourth signal line via which the information stored in the non-volatile memory can be transferred, a first connector circuit that connects the first signal line to the third signal line, and a second connector circuit that connects the second signal line to the fourth signal line.

16 Claims, 3 Drawing Sheets

INK JET HEAD AND INK JET PRINTER

CROSS-REFERENCE TO RELATED APPLICATION

This application is based upon and claims the benefit of priority from Japanese Patent Application No. 2016-181681, filed Sep. 16, 2016, the entire contents of which are incorporated herein by reference.

FIELD

Embodiments described herein relate generally to an ink jet head and an ink jet printer.

BACKGROUND

An ink jet printer prints patterns according to an input signal corresponding to an image or text. The ink jet printer includes, for example, an ink jet head and an ink jet head control circuit that controls the ink jet head. The ink jet head includes an actuator for ejecting ink and a driver integrated circuit (IC) that drives the actuator according to a control signal input from the ink jet head control circuit.

An ink jet head may include a non-volatile memory that stores unique information of the ink jet head, maintenance information, and the like. An inkjet head may share a signal line for driving an ink jet head and for accessing a non-volatile memory.

In a case where the signal line for driving the ink jet head and the signal line for accessing the non-volatile memory are shared, to access the non-volatile memory, it is necessary to place the inkjet head in a state in which the non-volatile memory can be accessed. For this reason, there is a problem that access to the non-volatile memory may be restricted.

DETAILED DESCRIPTION

In general, according to one embodiment, an ink jet head includes a nozzle connected to an ink chamber, an actuator configured to change a pressure of the ink chamber, a driver circuit configured to supply a drive waveform to the actuator in response to a control signal, a non-volatile memory configured to store information for setting the drive waveform, a first signal line via which a logic power supply voltage is supplied to the driver circuit, a second signal line via which the control signal is supplied to the driver circuit, a third signal line via which the logic power supply voltage is supplied to the non-volatile memory, a fourth signal line via which the information stored in the non-volatile memory can be transferred, a first connector circuit that connects the first signal line to the third signal line, and a second connector circuit that connects the second signal line to the fourth signal line.

Figure 1:
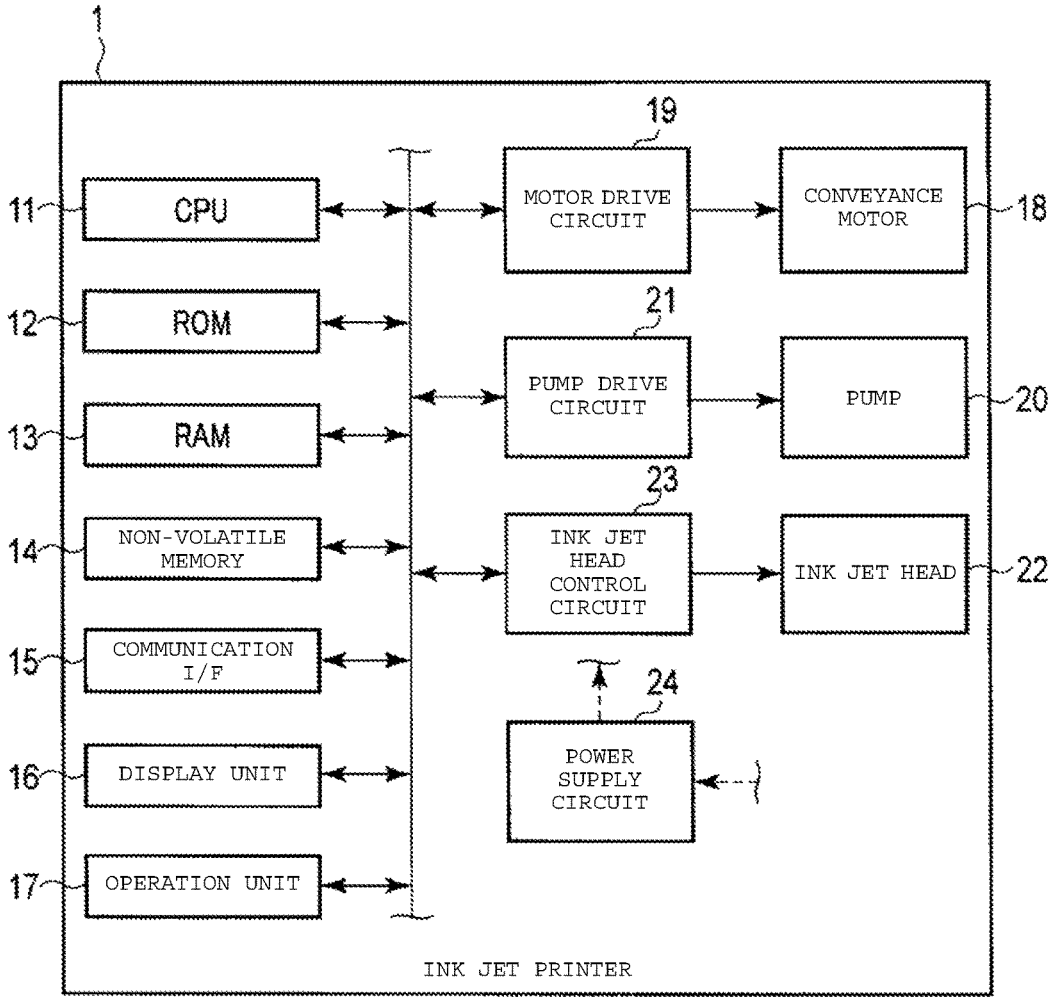
FIG. 1 is a diagram of an ink jet printer according to an embodiment.

Hereinafter, an ink jet printer and an ink jet head according to an example embodiment will be described with reference to the drawings. First, an ink jet printer will be described. FIG. 1 is a diagram of an ink jet printer 1.

The ink jet printer 1 is an example of an ink jet recording apparatus. The ink jet recording apparatus is not limited thereto and may be other apparatuses such as a copying machine.

The ink jet printer 1 performs various processes such as image formation while conveying paper which is a recording medium, for example. The inkjet printer 1 includes a CPU 11, a ROM 12, a RAM 13, a non-volatile memory 14, a communication interface (I/F) 15, a display unit 16, an operation unit 17, a conveyance motor 18, a motor drive circuit 19, a pump 20, a pump drive circuit 21, an ink jet head 22, an ink jet head control circuit 23, and a power supply circuit 24. Furthermore, the ink jet printer 1 may include a paper feed cassette and a paper discharge tray (not specifically depicted).

The CPU 11 is an arithmetic element, for example, a processor, that executes arithmetic processes. The CPU 11 performs various processes based on data such as a program stored in the ROM 12. The CPU 11 functions as a control unit or controller capable of executing various operations by executing the program stored in the ROM 12. The CPU 11 inputs print data for forming an image on the recording paper to the ink jet head control circuit 23. The CPU 11 inputs or supplies a conveyance control signal for controlling conveyance of the recording paper to the motor drive circuit 19. The CPU 11 inputs an ink supply control signal for controlling supply of ink to the pump drive circuit 21.

The ROM 12 is a read-only non-volatile memory. The ROM 12 stores a program and data used by the program.

The RAM 13 is a volatile memory functioning as a working memory. The RAM 13 temporarily stores data or the like being processed or manipulated by the CPU 11. The RAM 13 temporarily stores programs being executed by the CPU 11.

The non-volatile memory 14 is a storage medium that can store various information. The non-volatile memory 14 stores a program and data that may be used in the program. The non-volatile memory 14 is, for example, a solid-state drive (SSD), a hard disk drive (HDD), or other storage devices. Instead of a non-volatile memory 14, a memory interface (I/F) such as a card slot into which a storage medium such as a memory card can be inserted may be provided.

The communication I/F 15 is an interface for communicating with other devices. The communication I/F 15 is used for communication with, for example, a host device that transmits print data to the ink jet printer 1. The communication I/F 15 may perform wireless communication with other devices according to standards such as Bluetooth® or Wi-fi®.

The display unit 16 is a display device which displays a screen according to a video signal from the CPU 11 or a display control unit such as a graphic controller (not specifically depicted). For example, on the display unit 16, a screen for setting parameters or otherwise controlling the ink jet printer 1 can be displayed.

The operation controller 17 generates an input signal based on a user's operation of an input device, or the like. The input device connected to the operation controller 17 is, for example, a touch sensor, a ten key keypad, a power button, a paper feed key, various function keys, a keyboard, or the like. The touch sensor is, for example, a resistive touch sensor or a capacitive touch sensor. The touch sensor acquires information indicating a user designated position within a certain area. The touch sensor can be configured as a touch panel integrated with the above-described display unit 16 to input a signal indicating a touched position on a screen displayed on the display unit 16 to the CPU 11.

The conveyance motor 18 operates a conveyor device of a conveyance path (not specifically depicted) for conveying the paper by rotating the conveyor device. The conveyor device comprises, for example, a belt, a roller, a guide track, and the like which operate to convey the paper for a printing process. For example, the conveyance motor 18 conveys the paper along a guide track by driving a roller operating in conjunction with a belt that holds the paper.

The motor drive circuit 19 drives the conveyance motor 18. The motor drive circuit 19 drives the conveyance motor 18 in accordance with the conveyance control signal input from the CPU 11 to convey the paper from the paper feed cassette to the paper discharge tray while passing the inkjet head 22. The paper feed cassette is a cassette that accommodates a plurality of sheets of paper. The paper discharge tray accommodates the paper on which an image has been formed and that has been discharged by the ink jet printer 1.

The pump 20 includes a tube that communicates the ink jet head 22 with, for example, an ink tank (not specifically depicted) in which ink is held. Specifically, the tube communicates with a common liquid chamber (not specifically depicted) of the ink jet head 22.

The pump drive circuit 21 supplies ink from the ink tank to the common liquid chamber of the inkjet head 22 by driving the pump 20 according to the ink supply control signal from the CPU 11.

The ink jet head 22 is an image forming unit, such as a printer unit, that forms an image on the paper. The inkjet head 22 forms an image on the paper by ejecting ink onto the recording paper held by a holding roller (not specifically depicted). The ink jet printer 1 may include a plurality of the ink jet heads 22 corresponding to different colors such as cyan, magenta, yellow, and black, for example.

The ink jet head control circuit 23 drives the ink jet head 22. The ink jet head control circuit 23 causes ink to be ejected from the ink jet head 22 by driving the ink jet head 22. The ink jet head control circuit 23 drives the ink jet head 22, in accordance with the print data from the CPU 11 to form an image in accordance with the print data on the paper. The ink jet head control circuit 23 includes a drive control circuit that drives a driver IC 35 of the ink jet head 22 and a non-volatile memory control circuit that accesses the non-volatile memory 36 of the ink jet head 22.

The power supply circuit 24 converts AC power supplied from a commercial power supply (not specifically depicted) to DC power and supplies the DC power to components in the ink jet printer 1.

Figure 2:
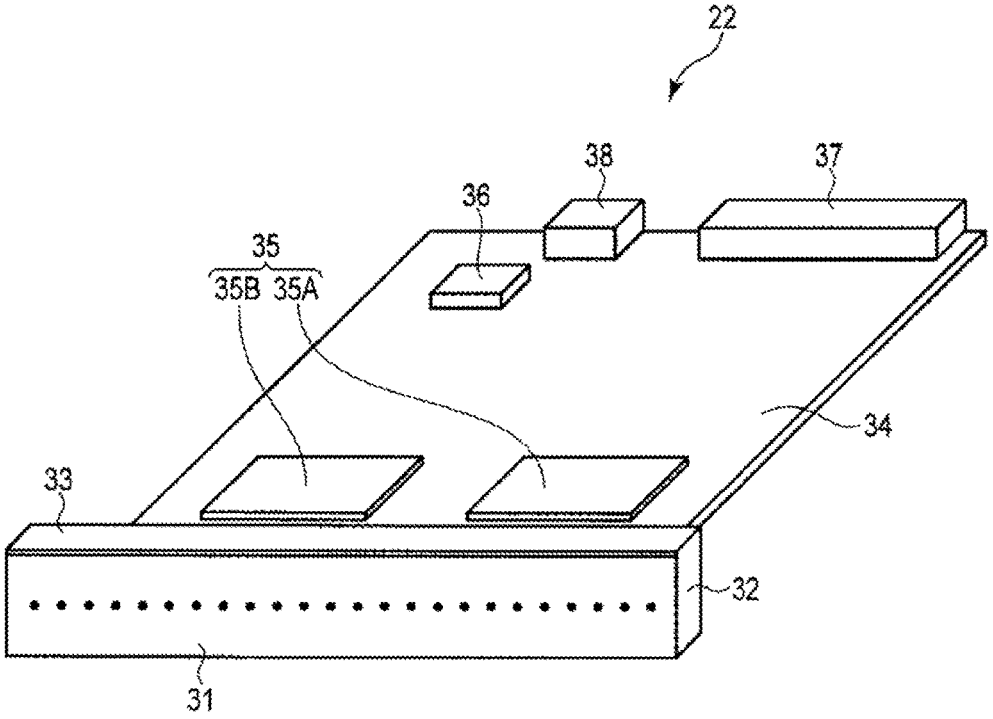
FIG. 2 is a diagram of an ink jet head according to an embodiment.

FIG. 2 shows an ink jet head 22. The ink jet head 22 includes a discharge nozzle 31, an ink liquid chamber 32, an actuator 33, a head substrate 34, a driver integrated circuit (IC) 35, a non-volatile memory 36, an interface (I/F) connector 37, and a non-volatile memory connector 38.

The discharge nozzle 31 is a hole through which ink is ejected.

The ink liquid chamber 32 is a space that can be filled with ink. The ink liquid chamber 32 includes a common liquid chamber (not specifically depicted) and a pressure chamber partitioned by an actuator 33 for each discharge nozzle 31. The common liquid chamber can be filled with ink supplied from the ink tank. The pressure chamber is a chamber whose pressure can be controlled by the actuator 33.

The actuator 33 is a piezoelectric element that causes a pressure change in the pressure chamber of the ink liquid chamber 32 by deforming according to an applied voltage input. The actuator 33 is driven by the voltage from the driver IC 35. When the actuator 33 is driven to lower the pressure inside the pressure chamber, ink is drawn from the common liquid chamber of the ink liquid chamber 32 into the pressure chamber of the ink liquid chamber 32. When the actuator 33 is driven to increase the pressure inside the pressure chamber of the ink liquid chamber 32, the ink in the pressure chamber of the ink liquid chamber 32 is ejected through the discharge nozzle 31.

The head substrate 34 is a substrate on which the discharge nozzle 31, the ink liquid chamber 32, the actuator 33, the driver IC 35, the non-volatile memory 36, the I/F connector 37 are mounted, and the non-volatile memory connector 38. The head substrate 34 can be configured as a glass-epoxy substrate or a flexible substrate using a polyimide film as a base material.

The ink jet head control circuit 23 controls the driver IC 35 to drive the actuator 33 by applying a potential with respect to an electrode (not specifically depicted) of the actuator 33. For example, the driver IC 35 generates a drive waveform for driving the actuator 33 according to an image data input from the inkjet head control circuit 23 and outputs the generated drive waveform to the actuator 33. Specifically, the driver IC 35 includes a register that temporarily stores the image data input from the inkjet head control circuit 23. Further, the driver IC 35 sets drive conditions according to the register setting data input from the ink jet head control circuit 23. The driver IC 35 generates the above-described drive waveform based on the image data stored in the register and the drive conditions. In the present example, the driver IC 35 includes two pieces, the driver IC 35A and the driver IC 35B, having the same configuration that are mounted on the head substrate 34.

The non-volatile memory 36 stores various information of the ink jet head 22. The non-volatile memory 36 is a one-wire non-volatile memory in which data can be stored and read via the same signal line. The non-volatile memory 36 stores, for example, unique information of the ink jet head 22, maintenance information, and the like. The unique information is, for example, the serial number of the ink jet head 22, a recommended voltage, an Acoustic Length (AL) rank, and the like. The AL rank indicates a characteristic vibration period of the ink in the ink liquid chamber 32 and is used for selecting a drive waveform. The maintenance information indicates a usage history of the inkjet head 22 such as date and time of a first use of the ink jet head 22, date and time of a last use, a number of lines that have been cumulatively printed, and an operating temperature, for example.

The I/F connector 37 is an interface for connecting the ink jet head control circuit 23 and the ink jet head 22.

The non-volatile memory connector 38 is an interface for connecting the non-volatile memory 36 and a device (non-volatile memory control circuit) for accessing (such as reading and writing) the ink jet head control circuit 23 or the non-volatile memory 36.

Figure 3:
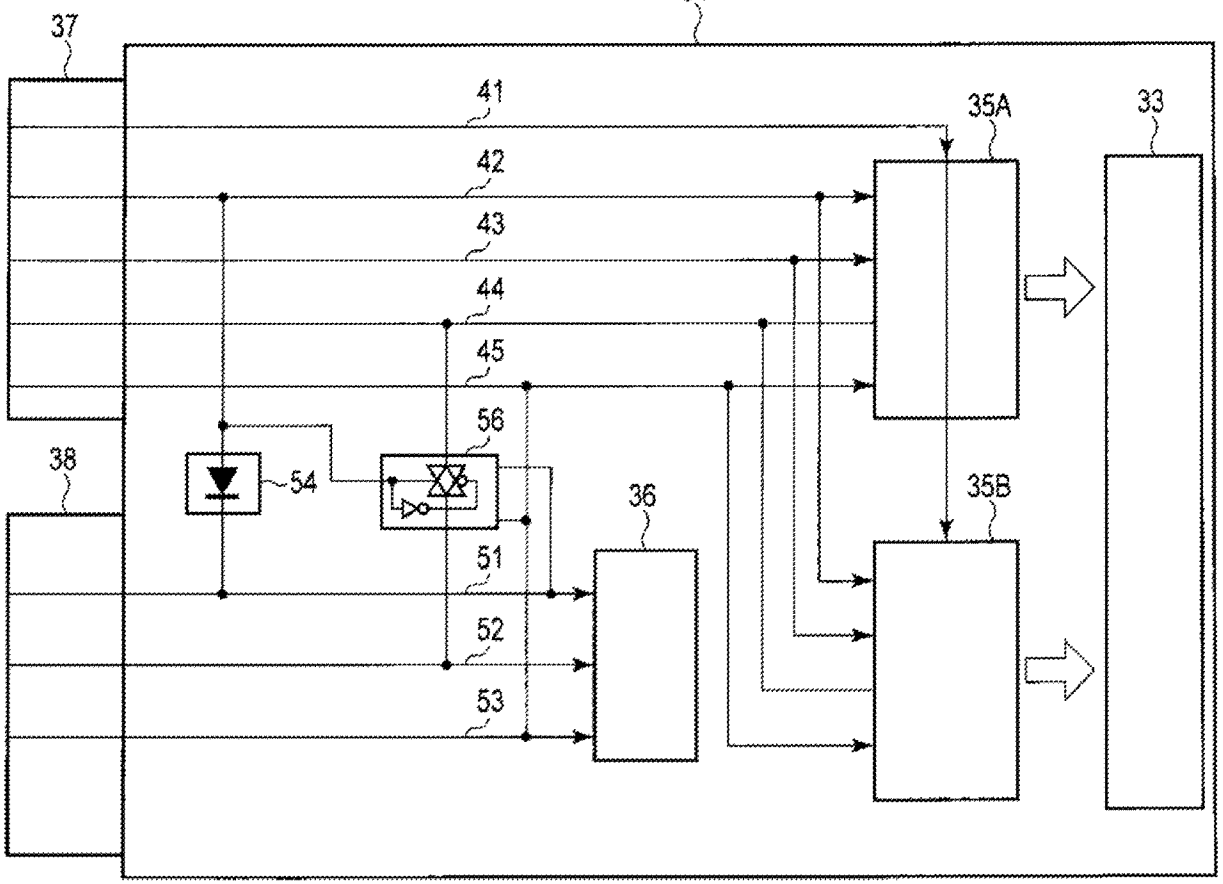
FIG. 3 is a diagram of an ink jet head according to an embodiment.

FIG. 3 shows an ink jet head 22. The ink jet head 22 and the ink jet head control circuit 23 are connected via the I/F connector 37.

The ink jet head control circuit 23 supplies a drive power supply, a logic power supply, and a driver IC control signal to the driver ICs 35A and 35B. The drive power supply is used for generating a drive waveform for driving the actuator 33 in the driver ICs 35A and 35B. The logic power supply is used for powering the logic circuit in the driver ICs 35A and 35B and driving switching elements.

The driver IC control signal is used for generating a drive waveform for driving the actuator 33 in the driver ICs 35A and 35B. Further, the driver IC control signal may be, for example, a signal for setting a reference waveform of the drive waveform generated in the driver ICs 35A and 35B.

As shown in FIG. 3, the ink jet head 22 and the ink jet head control circuit 23 are connected via the I/F connector 37. Within the I/F connector 37, the ink jet head control circuit 23 and the driver IC 35A and the driver IC 35B have signal lines 41 to 45 therebetween.

The signal line 41 is used to supply a drive power supply from the ink jet head control circuit 23 to the driver IC 35A and the driver IC 35B.

The signal line 42 is used to supply a logic power supply from the ink jet head control circuit 23 to the driver IC 35A and the driver IC 35B.

The signal line 43 is connected to a terminal for inputting the driver IC control signal from the ink jet head control circuit 23 to the driver IC 35A and the driver IC 35B. The signal line 43 is used to supply the driver IC control signal from the ink jet head control circuit 23 to the driver IC 35A and the driver IC 35B.

The signal line 44 is connected to a terminal for outputting the driver IC control signal to the ink jet head control circuit 23 from the driver IC 35A and the driver IC 35B. The signal line 44 is used to supply the driver IC control signal from the driver IC 35A and the driver IC 35B to the ink jet head control circuit 23.

The signal line 45 is connected to a ground (GND) in the ink jet head control circuit 23, and the driver IC 35A and the driver IC 35B. The signal line 45 is used for connecting to GND.

Controlled by the CPU 11, the ink jet head control circuit 23 supplies a drive power supply and a logic power supply to the driver ICs 35A and 35B via the signal lines 41 and 42.

Controlled by the CPU 11, the ink jet head control circuit 23 supplies the driver IC control signal to the driver ICs 35A and 35B by the signal lines 43. First, controlled by CPU 11, the ink jet head control circuit 23 supplies the driver IC control signal for setting the reference waveform to the driver ICs 35A and 35B by the signal line 43.

When the driver ICs 35A and 35B, referred to as the driver IC 35, receive the driver IC control signal for setting the reference waveform from the ink jet head control circuit 23, the driver ICs 35A and 35B set the drive conditions, for example, a shape of a drive waveform, according to the received driver IC control signal. Specifically, the driver IC 35 analyzes a value of the driver IC control signal, and if the value is normal, completes the setting of the drive conditions by storing the driver IC control signal in the register. When the setting of the drive conditions is completed, the driver IC 35 sets the terminal to which the signal line 44 is connected as a high-impedance (Hi-z) state.

For example, the driver IC 35 includes a control switch (not specifically depicted) that controls a conduction state between the terminal to which the signal line 44 is connected and the GND. The control switch, for example, is an open drain type FET that is conductive between the signal line 44 and GND when the control switch is turned on and releases the signal line 44 and GND when the control switch is turned off.

Specifically, the driver IC 35 sets the potential of the signal line 44 to GND by turning on the control switch when the setting of the drive conditions is not completed. That is, the driver IC 35 sets the potential of the signal line 44 to a low level when the setting of the drive conditions is not completed. When at least one of the driver IC 35A and the driver IC 35B turns on the control switch, the potential of the signal line 44 is lowered to a low level.

When the setting of the drive conditions is completed, the driver IC 35 releases the signal line 44 by turning off the control switch and setting a terminal to which the signal line 44 is connected in a high impedance state. When the control switches of both the driver IC 35A and the driver IC 35B are turned off, the signal line 44 is released from the driver IC 35A and the driver IC 35B.

The non-volatile memory connector 38 has a signal line 51 for supplying a power supply to the non-volatile memory 36, a signal line 52 for communicating data with the non-volatile memory 36, and a signal line 53 that is connected to the GND. The signal lines 51, 52, and 53 make connections using the non-volatile memory connector 38, respectively.

The signal line 51 is connected to the signal line 42 via a diode 54. The signal line 42 is connected to the anode side of the diode 54, and the signal line 51 is connected to the cathode side of the diode 54. That is, the diode 54 is an element that performs rectification so that power is supplied from the signal line 42 to the signal line 51.

The signal line 52 is connected to the signal line 44 via a complementary metal-oxide-semiconductor (CMOS) analog switch circuit 56. The CMOS analog switch circuit 56 is a switching element for controlling conductivity between the signal line 44 and the signal line 52. When power is supplied from a power supply terminal of the CMOS analog switch circuit 56 and a voltage equal to or higher than a predetermined threshold value is input to a control terminal of the CMOS analog switch circuit 56, the CMOS analog switch circuit 56 is switched to be conductive between the signal line 44 and the signal line 52. The power supply terminal of the CMOS analog switch circuit 56 is connected to the signal line 51. The control terminal of the CMOS analog switch circuit 56 is connected to the anode side of the diode 54. When power is supplied from the signal line 51 and the voltage of the signal line 42 is equal to or higher than a predetermined threshold value, the CMOS analog switch circuit 56 is conductive between the signal line 44 and the signal line 52. The CMOS analog switch circuit 56 may be replaced by some other switch that changes conductivity between the signal line 44 and the signal line 52 according to the voltage of the signal line 51 and the signal line 42.

Further, the signal line 53 is connected to the signal line 45 and thus to the GND.

In the above configuration, the ink jet head 22 and the ink jet head control circuit 23 are connected via the I/F connector 37. When the signal line 44 is not released by the driver IC 35, even if the CMOS analog switch circuit 56 is conductive when power supplied to the signal line 51 from the signal line 44 via the diode 54, both the signal line 44 and the signal line 52 are connected to the GND. Therefore, the ink jet head control circuit 23 cannot access the non-volatile memory 36.

In addition, in the configuration as described above, it is assumed that the ink jet head 22 and the ink jet head control circuit 23 are connected via the I/F connector 37 and that the signal line 44 can be released from the driver IC 35. In this case, when power is supplied to the signal line 51 from the signal line 44 via the diode 54, and the CMOS analog switch circuit 56 is conductive, the voltages of the signal line 44 and the signal line 52 match. The ink jet head control circuit 23 can access the non-volatile memory 36 by controlling the voltages of the signal line 44 and the signal line 52 to a low level and a high level. That is, when the signal line 44 is released from the driver IC 35, access to the non-volatile memory 36 by the inkjet head control circuit 23 is permitted. When the access to the non-volatile memory 36 by the ink jet head control circuit 23 is permitted, the non-volatile memory control circuit controls the signal line 52 by controlling the voltage of the signal line 44 released from the driver IC 35. In this way, the non-volatile memory control circuit can communicate data with the non-volatile memory 36.

In the configuration as described above, when the ink jet head control circuit 23 is not connected to the I/F connector 37 and the non-volatile memory control circuit is connected to the non-volatile memory connector 38, the non-volatile memory control circuit supplies power to the non-volatile memory 36 via the signal line 51. The non-volatile memory control circuit accesses the non-volatile memory 36 via the signal line 52. In this case, the diode 54 connected between the signal line 51 and the signal line 42 prevents the voltage of the signal line 51 from raising the potential of the signal line 42. Since the voltage of the signal line 42 connected to the control terminal of the CMOS analog switch circuit 56 is lower than a predetermined threshold value, the CMOS analog switch circuit 56 is not conductive between the signal line 44 and the signal line 52. With such a configuration, when the ink jet head control circuit 23 is not connected to the I/F connector 37 and the non-volatile memory control circuit is connected to the non-volatile memory connector 38, it is possible to prevent the voltage of the signal line 51 and the signal line 52 from raising the potentials of the signal line 42 and the signal line 44.

As described above, the non-volatile memory connector 38 of the ink jet head 22 includes signal line 51 for power supply, signal line 52 for data communication, and signal line 53 connected to GND. In addition, the ink jet head 22 includes the driver IC 35 that drives the actuator 33, the signal line 42 which supplies power to the driver IC 35, and the signal line 44 to which the driver IC control signal for controlling the driver IC 35 is supplied from the ink jet head control circuit 23. Further, the ink jet head 22 includes the diode 54 having a cathode connected to the signal line 51 and an anode connected to the signal line 42. The ink jet head 22 includes the CMOS analog switch circuit 56 that receives power from the signal line 51 and changes conductivity between the signal line 52 and the signal line 44 according to the voltage of the cathode of the diode 54. In this way, the ink jet head control circuit 23 can access the non-volatile memory 36 by controlling the ink jet head 22 via the I/F connector 37 in a normal state. In addition, the non-volatile memory control circuit can access the non-volatile memory 36 via the non-volatile memory connector 38. The diode 54 and the CMOS analog switch circuit 56 can prevent the signal input via the non-volatile memory connector 38 from affecting the signal line for controlling the driver IC 35. The non-volatile memory control circuit can access the non-volatile memory 36 without operating the driver IC 35. Thus, the ink jet head and the ink jet printer with added convenience can be provided.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An ink jet head, comprising:

a nozzle connected to an ink chamber;

an actuator configured to change a pressure of the ink chamber;

a driver circuit configured to supply a drive waveform to the actuator in response to a control signal;

a non-volatile memory configured to store information for setting the drive waveform;

a first signal line via which a logic power supply voltage is supplied to the driver circuit;

a second signal line via which the control signal is supplied to the driver circuit;

a third signal line via which the logic power supply voltage is supplied to the non-volatile memory;

a fourth signal line via which the information stored in the non-volatile memory can be transferred;

a first connector circuit that connects the first signal line to the third signal line; and a second connector circuit that connects the second signal line to the fourth signal line, wherein the first connector circuit is a diode having an anode connected to the first signal line and a cathode connected to the third signal line, the second connector circuit is a switching element having a power supply terminal and a control terminal, the control terminal being connected to the first signal line, the power supply terminal being connected to the third signal line, when the logic power supply voltage from the third signal line is higher than a predetermined threshold value, the switching element electrically connects the second signal line and the fourth signal line, and when the logic power supply voltage from the third signal line is lower than the predetermined threshold value, the switching element does not electrically connect the second signal line and the fourth signal line.

2. The ink jet head according to claim 1, wherein the switching element is a complementary metal-oxide-semiconductor analog switch circuit.

3. The ink jet head according to claim 1, wherein the control signal is supplied via the second signal line when the switching element is not electrically connecting the second signal line and the fourth signal line.

4. The ink jet head according to claim 1, wherein the non-volatile memory is accessed via the fourth signal line when the switching element is electrically connecting the second signal line and the fourth signal line.

5. The ink jet head according to claim 1, wherein the drive waveform is determined according to register setting data supplied from the non-volatile memory to the driver circuit, and the drive waveform is output from the non-volatile memory to the driver circuit when the switching element is not electrically connecting the second signal line and the fourth signal line.

6. The ink jet head according to claim 1, further comprising:

a non-volatile memory connector having a first terminal to which the second signal line is connected and a second terminal to which the fourth signal line is connected.

7. An ink jet printer, comprising:

an ink jet head; and an ink jet head control circuit connected to the ink jet head, wherein the ink jet head includes:

a nozzle connected to an ink chamber;

an actuator configured to change a pressure of the ink chamber;

a driver circuit configured to supply a drive waveform to the actuator in response to a control signal;

a non-volatile memory configured to store information for setting the drive waveform;

a first signal line via which a logic power supply voltage is supplied to the driver circuit;

a second signal line via which the control signal is supplied to the driver circuit;

a third signal line via which the logic power supply voltage is supplied to the non-volatile memory;

a fourth signal line via which the information stored in the non-volatile memory can be transferred;

a first connector circuit that connects the first signal line to the third signal line; and a second connector circuit that connects the second signal line to the fourth signal line, and the ink jet head control circuit includes:

a drive control circuit configured to supply the logic power supply voltage to the driver circuit via the first signal line and output the control signal to the driver circuit via the second signal line; and a non-volatile memory control circuit that can access the non-volatile memory via the third signal line and the fourth signal line, wherein the first connector circuit is a diode having an anode connected to the first signal line and a cathode connected to the third signal line, the second connector circuit is a switching element having a power supply terminal and a control terminal, the control terminal being connected to the first signal line, the power supply terminal being connected to the third signal line, when the logic power supply voltage from the third signal line is higher than a predetermined threshold value, the switching element electrically connects the second signal line and the fourth signal line, and when the logic power supply voltage from the third signal line is lower than the predetermined threshold value, the switching element does not electrically connect the second signal line and the fourth signal line.

8. The ink jet printer according to claim 7, wherein the switching element is a complementary metal-oxide-semiconductor analog switch circuit.

9. The ink jet printer according to claim 7, wherein the control signal is supplied via the second signal line when the switching element is not electrically connecting the second signal line and the fourth signal line.

10. The ink jet printer according to claim 7, wherein the non-volatile memory is accessed via the fourth signal line when the switching element is electrically connecting the second signal line and the fourth signal line.

11. The ink jet head according to claim 7, wherein the drive waveform is determined according to register setting data supplied from the non-volatile memory to the driver circuit, and the drive waveform is output from the non-volatile memory to the driver circuit when the switching element is not electrically connecting the second signal line and the fourth signal line.

12. An ink jet head, comprising:

a nozzle in fluid communication with an ink chamber;

an actuator configured to change a pressure in the ink chamber according to a drive waveform;

a driver circuit configured to supply the drive waveform to the actuator in response to a control signal;

a non-volatile memory configured to store information for setting the drive waveform;

an interface connector having a first terminal at which a first signal line can be connected and a second terminal at which a second signal line can be connected, the first terminal and the second terminal being connected to driver circuit, a memory connector having a third terminal at which a third signal line can be connected and a fourth terminal at which a fourth signal line can be connected, the third and fourth terminals being connected to the non-volatile memory;

a diode having an anode electrical connected to the first terminal and a cathode electrically connected to the third terminal; and a switching element having a control terminal electrically connected to the first terminal of the interface connector and configured to switch conductance states to electrically connect and disconnect the second and fourth terminals according to a potential applied to the control terminal via the first terminal.

13. The ink jet head according to claim 12, wherein the first signal line is a first power supply line, the second signal line is a control signal line by which the control signal is supplied to the driver circuit, the third signal line is a second power supply line, and the fourth signal line is data communication line by which information is supplied to the non-volatile memory for storage.

14. The ink jet head according to claim 13, wherein non-volatile memory control circuit accesses the non-volatile memory via the fourth signal line when the switching element is conductive between the second signal line and the fourth signal line.

15. The ink jet head according to claim 12, wherein the switching element is a complementary metal-oxide-semiconductor analog switch circuit.

16. The ink jet head according to claim 12, further comprising:

an actuator substrate on which the driver circuit, the non-volatile memory, the interface connector, and the memory connector are disposed.

* * * * *